US010397984B2

(12) United States Patent
Ruperee

(10) Patent No.: US 10,397,984 B2
(45) Date of Patent: Aug. 27, 2019

(54) RANGE WITH SUSPENDED COOKTOP

(71) Applicant: Whirlpool Corporation, Benton Harbor, MI (US)

(72) Inventor: Prashant Ruperee, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 288 days.

(21) Appl. No.: 15/265,426

(22) Filed: Sep. 14, 2016

(65) Prior Publication Data

US 2017/0006665 A1 Jan. 5, 2017

Related U.S. Application Data

(62) Division of application No. 13/873,313, filed on Apr. 30, 2013, now Pat. No. 9,447,978.

(51) Int. Cl.
*H05B 3/68* (2006.01)
*F24C 15/10* (2006.01)

(52) U.S. Cl.
CPC ..... *H05B 3/68* (2013.01); *F24C 15/108* (2013.01); *Y10T 29/49826* (2015.01)

(58) Field of Classification Search
CPC ..... F24C 15/10–108; Y10T 29/49826; H05B 3/68
USPC ..... 219/443.1–468.2; 126/216, 214 A
See application file for complete search history.

(56) References Cited

U.S. PATENT DOCUMENTS

| | | | | |
|---|---|---|---|---|
| 2,572,151 A | | 10/1951 | Hoppe | |
| 3,051,160 A | | 8/1962 | Nielsen | |
| 3,142,295 A | * | 7/1964 | Blee | A47B 77/08 126/37 R |
| 3,257,543 A | | 6/1966 | Regan et al. | |
| 3,400,707 A | | 9/1968 | Owens | |
| 3,422,812 A | | 1/1969 | More | |
| 3,578,951 A | | 5/1971 | Ingro, Jr. | |
| 4,004,570 A | | 1/1977 | Keeling, Sr. | |
| 4,778,978 A | * | 10/1988 | Schreder | H05B 3/748 219/447.1 |
| 4,788,414 A | | 11/1988 | Schreder | |
| 5,036,831 A | * | 8/1991 | Ray | F24C 15/108 126/211 |
| 5,571,434 A | | 11/1996 | Cavener et al. | |
| 5,788,414 A | | 8/1998 | Gordon | |
| 5,791,336 A | * | 8/1998 | Helm | F24C 15/108 126/214 A |
| 7,703,384 B2 | | 4/2010 | Annis et al. | |

(Continued)

*Primary Examiner* — Sang Y Paik
(74) *Attorney, Agent, or Firm* — Diederiks & Whitelaw, PLC.

(57) ABSTRACT

A slide-in or drop-in cooking range includes an upper cooktop in the form of a module suspended above an oven cavity. For installation purposes, the upper cooktop can be vertically repositioned relative to the oven cavity to assure proper alignment with the countertop and avoid damage to the cooktop as a result of combined thermal and mechanical stresses over time. The disclosure is particularly applicable to ranges employing glass cooktops having a periphery designed to rest upon edge portions of a countertop and contemplates various mechanisms to perform the cooktop repositioning function, including select mechanisms for locking, ratcheting and biasing the cooktop to establish a desired vertical position for the cooktop.

20 Claims, 4 Drawing Sheets

(56) References Cited

U.S. PATENT DOCUMENTS

| | | | | |
|---|---|---|---|---|
| 2007/0277802 | A1 | 12/2007 | Reed et al. | |
| 2007/0289599 | A1* | 12/2007 | Klemm | A61B 90/60<br>128/845 |
| 2012/0266858 | A1 | 10/2012 | Avila et al. | |
| 2014/0030011 | A1* | 1/2014 | Baus | F16B 7/105<br>403/321 |

* cited by examiner

RANGE WITH SUSPENDED COOKTOP

CROSS-REFERENCE TO RELATED APPLICATIONS

This application is a divisional of U.S. patent application Ser. No. 13/873,313 filed on Apr. 30, 2013. The entire content of this application is incorporated by reference.

BACKGROUND

Technical Field

The present disclosure pertains to the art of cooking and, more particularly, to a range including a cabinet housing an oven and supporting, for relative vertical movement, a suspended cooktop.

Background

In the art of cooking, both slide-in and drop-in ranges are known. Basically, both types of ranges are designed to be situated in a space or cut-out provided along a length of a kitchen countertop, with the cut-out including an open front provided between lower cabinetry in the case of a slide-in range. In either case, the range includes at least one oven cavity supported within a cabinet, as well as a cooktop fixedly mounted to the cabinet. In many situations, the cooktop of the range is configured to extend over edge portions of the countertop about the cut-out, such as with slide-in or drop-in ranges including glass cooktops. Under these circumstances, the range must be positioned relative to two horizontal surfaces, i.e., the floor and the upper countertop surfaces, with a rather low level of tolerance. With the oven cavity and the cooktop both being fixed relative to the cabinet and each other, any vertical repositioning is accomplished through adjustable feet which enable the oven cavity and cooktop to be selectively raised or lowered in unison.

Even though countertops are generally manufactured in standard heights, this mounting configuration must take into account variable factors, including thermal and mechanical loadings, which can result in varying assembly dimensions. For instance, even if the floor and the countertop are initially level such that the range can be properly adjusted when initially installed, various factors can alter this configuration such that the distance from the floor to the top surface of the countertop can change over time. These variations can place damaging loads on the cooktop, particularly in the case of a range with a glass cooktop.

With the above in mind, it is desired in accordance with the present disclosure to provide a range including a cooktop module which can be vertically adjusted relative to a remainder of the range, thereby enabling the cooktop to readily accommodate for manufacturing and operating variations.

SUMMARY

The present disclosure is directed to a slide-in or drop-in cooking range including a cooktop which is suspended above an oven such that the cooktop can be vertically shifted relative to the oven in order to accommodate varying height requirements. More specifically, the cooktop takes the form of a module which can be initially supported at a height above a final installation position and, following installation and leveling of the overall range relative to a kitchen floor, lowered to a position either aligned with or upon an adjacent kitchen countertop. For shipping purposes, the cooktop module can be retained in a fixed height position through a locking mechanism which is released to permit the desired relative vertical adjustment.

In accordance with the disclosure, the range can be properly positioned relative to adjacent cabinetry and the cooktop separately aligned with the countertop in a manner which eliminates or reduces loading on the cooktop as a result of combined thermal and mechanical stresses. The disclosure contemplates various locking and adjusting mechanisms to perform the cooktop positioning function, including a removable locking pin which, when released, allows the cooktop to move down under its own weight, a screw or ratcheting mechanism providing select vertical adjustment, and the use of a cooktop biasing arrangement which provides for vertically shifting of the cooktop against an established spring force.

Additional objects, features and advantages of the disclosure will become readily apparent from the following detailed description of the disclosure when taken in conjunction with the drawings wherein like reference numerals refer to corresponding parts in the several views.

DETAILED DESCRIPTION

Figure 1:
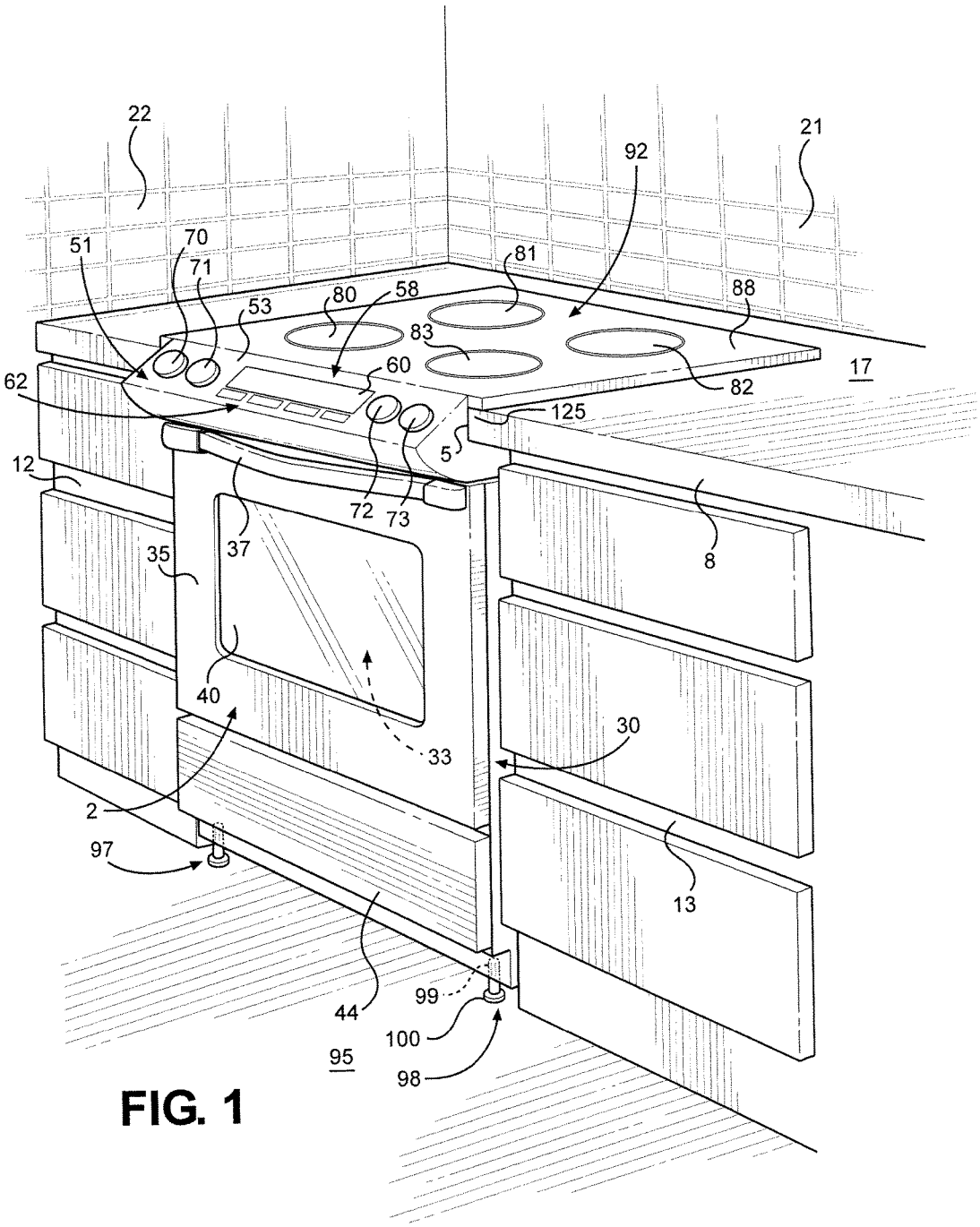
FIG. 1 is a perspective view of a range incorporating the adjustable cooktop of the present disclosure shown positioned along kitchen cabinetry.

With initial reference to FIG. 1, a cooking appliance taking the form of a free-standing, slide-in range 2 is shown positioned in a cut-out or opening 5 provided in a countertop 8 and between adjacent lower cabinetry 12 and 13. Countertop 8 has an upper surface 17 which extends between upstanding rear and side walls 21 and 22 respectively. Range 2 includes a cabinet 30 which supports an oven cavity 33 located behind a door 35 having a handle 18 and a window 40. In a manner known in the art, door 35 can be pivoted to access oven cavity 33 of range 2. Also, as shown, range 2 includes a lower drawer 44 for use in storing pans and the like.

Within the scope of the disclosure, range 2 can take on various forms. In the embodiment illustrated, range 2 includes an upper control panel 51 having an angled front face 53. Provided along angled front face 53 is a central oven control section 58 that includes a display 60 and a set of control buttons or pads 62. Although not considered part of the present disclosure, for the sake of completeness, display 60 and the set of control buttons or pads 62 enable programming functions for range 2, including setting desired cooking operations and times for oven cavity 33, clock settings and the like. In addition, control panel 51 is shown provided with a plurality of control knobs 70-73 for regulating operation of upper heating elements 80-83 arranged about an upper panel 88 of a cooktop 92 of range 2.

At this point, it should be noted that cooktop 92 can take various forms. For instance, in certain embodiments, upper panel 88 is represented by a glass or ceramic/glass cooktop surface, but could also be formed of other materials. In addition, heating elements 80-83 are depicted as electric induction heating elements, but could be constituted by various known heating elements, including electric resistance-type heating elements and even gas burners, either mounted above or below upper panel 88. For example, range 2 could be defined by a gas cooking range with a gas-under-glass cooktop. In addition, range 2 need not be a slide-in range, but could also be a drop-in range without departing from the disclosure. In either case, range 2 is supported upon a floor 95 and can be provided with leg levelers, such as represented by front leg levelers 97 and 98, each of which includes a threaded shaft 99 and a base or foot 100, which can be used to vertically adjust cabinet 30 and cooktop 92 simultaneously relative to countertop 8. Such leg leveler arrangements are widely known in the art of appliances, including ranges, dishwashers and refrigerators.

Figure 2:
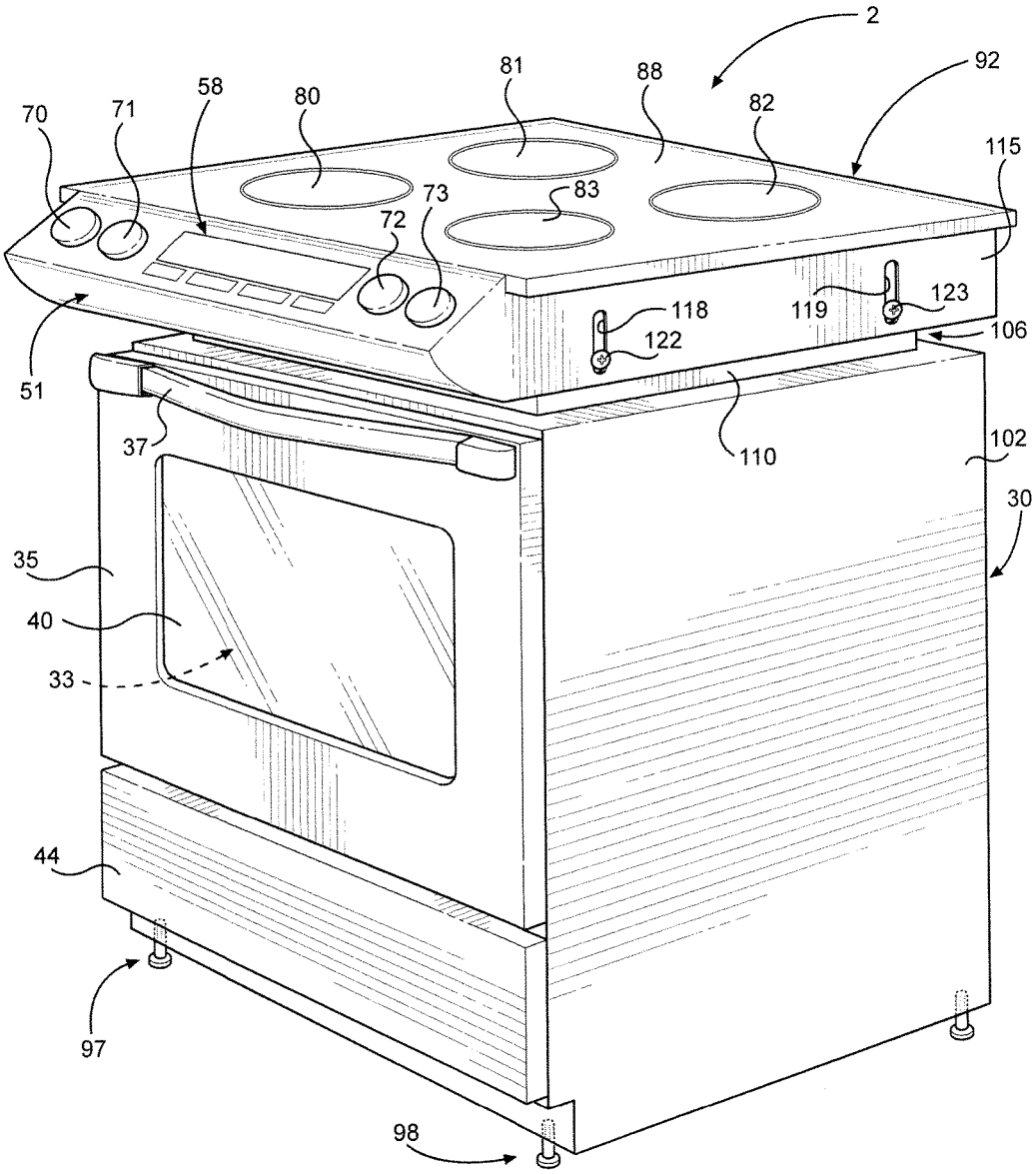
FIG. 2 is a perspective view of a range with a suspended cooktop constructed in accordance with one embodiment of the disclosure.

In general, the construction and operation of cooking appliance 2 as described until this point is known in the art such that this description has merely been provided for the sake of completeness. To this end, additional details of the construction or operation will not be provided here. However, as will be detailed more fully below, unlike a conventional range, cooktop 92 takes the form of a module which can be vertically repositioned relative to cabinet 30 and oven cavity 33. More specifically, with reference to one embodiment of the disclosure as shown in FIG. 2, cabinet 30 is shown to include side panels, one of which is indicated at 102, as well as an upper support 106 having upstanding side portions, one of which is indicated at 110. In addition, the cooktop module includes control panel 51, panel 88 with the plurality of heating elements 80-83 and side walls, one of which is indicated at 115. Each side wall 115 is provided with a pair of fore-to-aft spaced and vertically extending slots 118 and 119. Extending through each slot 118, 119 and threadably attached to an upstanding side portion 110 of support 106 is a respective mechanical fastener 122, 123, such as a sheet metal screw.

With this arrangement, cooktop 92 can be selectively adjusted vertically relative to cabinet 30 and oven cavity 33. That is, in the position shown in this figure, cooktop 92 is in a raised position relative to cabinet 30 and oven cavity 33. However, by loosening fasteners 122 and 123, the cooktop module can be vertically adjusted relative to these components. Therefore, the front and rear leg levelers, including leg levelers 97 and 98, can be used to initially level the overall range 2 relative to floor 95, however these levelers need not be relied upon to assure that plate 88 is at an appropriate height to extend over edge portions, such as indicated at 125 in FIG. 1, of countertop 8. Instead, the attachment of the cooktop module to cabinet 30 establishes a locking and adjusting mechanism interconnecting cooktop 92 to cabinet 30 while permitting cooktop 92 to be vertically shifted relative to oven cavity 33. To this end, a separate, dedicated vertical adjustment can be made to assure that cooktop 92 is properly positioned relative to countertop 8 in order to prevent any damaging loading of cooktop 92, particularly in the case where range 2 includes a glass cooktop 92.

In the illustrated embodiment of a slide-in range 2, fasteners 122 and 123 on each side of range 2 will be initially tightened to maintain cooktop 92 in a lowered position for packing and shipping purposes. However, when it is desired to install range 2 within cut-out 5 between cabinetry 12 and 13, the height of cooktop 92 can be readily adjusted to a desired level and then retained in that position through fasteners 122 and 123 prior to sliding range 2 into position. In the alternative, fasteners 122 and 123 can be simply released so as to remain in a loosened condition, whereupon panel 88 of cooktop 92 will rest upon edge portions 125 of countertop 8 due to gravity.

Figure 3:
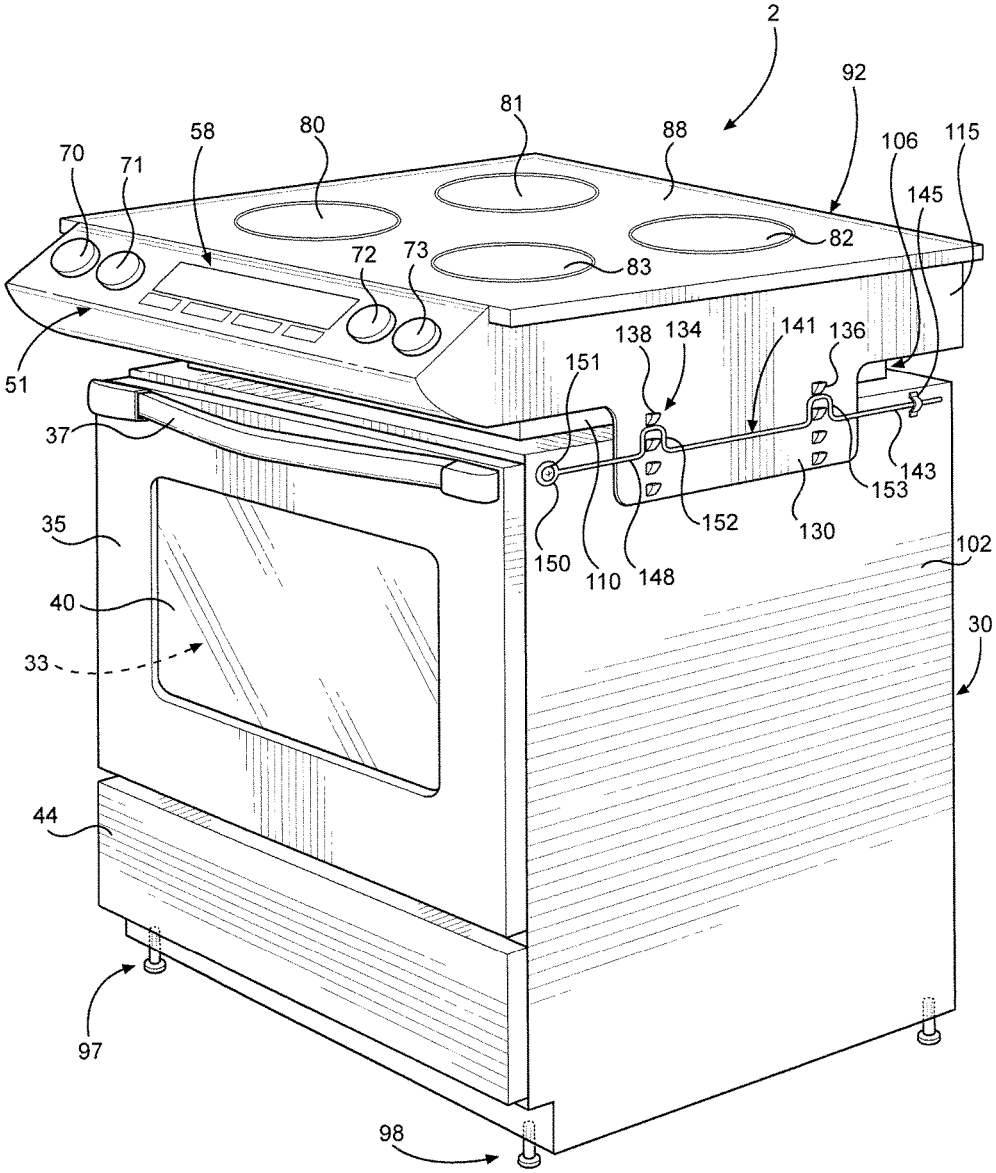
FIG. 3 is a perspective view of a range with a suspended cooktop constructed in accordance with another embodiment.

At this point it should be realized that a wide range of mechanisms could be employed to interconnect cooktop 92 to cabinet 30 while permitting cooktop 92 to be vertically shifted relative to oven cavity 33. To this end, reference will now be made to another embodiment shown in FIG. 3 which employs another potential locking and adjusting mechanism. As shown, each side wall 115 of the cooktop module is provided with a side extension plate 130. Provided at varying height positions on side extension plate 130 are a plurality of spaced notch elements, such as indicated at 134. Each notch element 134 is shown to include a sloped or angled surface portion 136 and a catch portion 138. Notch elements 134 can be integrally formed with side extension plate 130, such as being stamped therein, or formed on a separate bracket attached to side extension plate 130. In either case, notch elements 134 cooperate with a bar 141 to establish a locking and adjusting mechanism for cooktop 92.

More specifically, bar 141 includes a first end portion 143 which is received in and pivotally supported by a sleeve member 145 attached to cabinet 30, and a second end portion 148 which is shown to include a closed end loop 150 and can also be attached to cabinet 30 through a mechanical fastener 151. Between first and second end portions 143 and 148, bar 141 is formed with fore-to-aft spaced offset sections 152 and 153 which are aligned with spaced rows of notch elements 134. With this arrangement, cooktop 92 can be fixed in various vertically spaced positions, with offset sections 152 and 153 of bar 141 engaging with catch portions 138 of respective notch elements 134. Given the inclusion of sloped or angled surface portions 136, this arrangement also advantageously establishes a ratcheting function. That is, with first end portion 143 of bar 141 within sleeve member 145 and second end portion 148 of bar 141 secured to cabinet 30 with mechanical fastener 151, bar 141 will be biased against side extension plate 130 and will frictionally hold cooktop 92 in an established vertical position between respective sets of spaced notch elements 134. However, from a raised position, cooktop 92 can be pushed downward, causing offset sections 152 and 153 to ride upon sloped or angled surface portions 136 of the notch elements 134 and then snap back against side extension plate 130 after passing respective catch portions 138. Therefore, this arrangement advantageously enables range 2 to be initially slid into position within cut-out 5 of countertop 8 and then cooktop 92 can be lowered onto top surface 17 of countertop 8 by simply pushing down upon panel 88. Certainly, without departing from the spirit of the disclosure, various types of ratcheting mechanisms could be employed for this purpose. In addition, it should be realized that, instead of ratcheting to a lowered position, the cooktop module could be ratcheted to a raised position.

Figure 4:
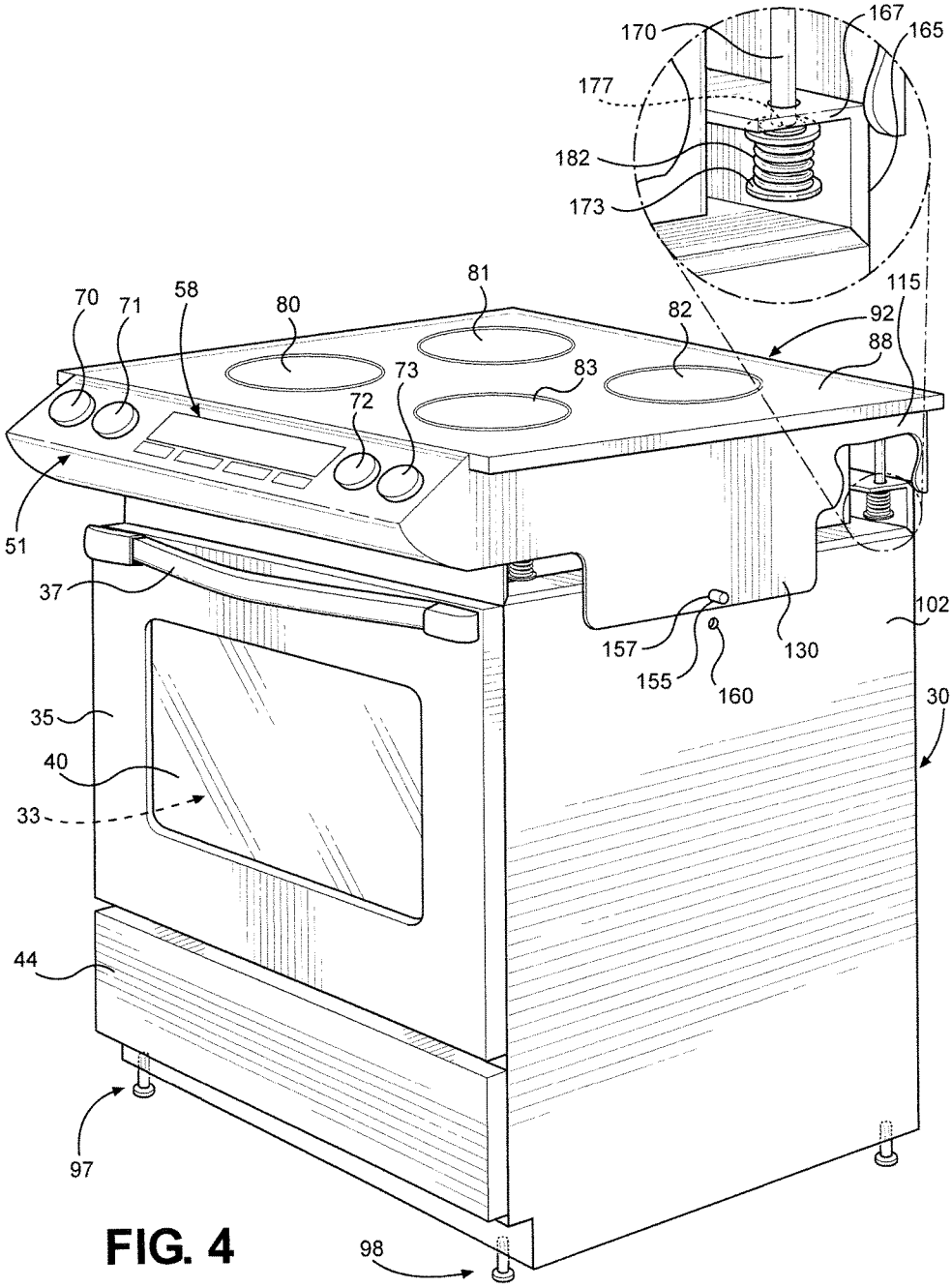
FIG. 4 is a perspective view of a range with a suspended cooktop constructed in accordance with a further embodiment.

FIG. 4 depicts a still further exemplary embodiment wherein cooktop 92 can be locked in a desired position for packaging and shipping purposes, yet biased into engagement with countertop 8 upon installation. To this end, this embodiment provides a pin 155 which can be inserted through an aperture 157 formed in side extension plate 130 and an aligned opening 160 formed in side panel 102 of cabinet 30 to lock cooktop 92 in a desired vertical position. If a series of locking positions are desired, side extension plate 130 and/or side panel 102 can be provided with various vertically spaced apertures 157 or openings 160 respectively for alignment and receipt of pin 155.

Also, in accordance with this embodiment, cabinet 30 is provided with corner extended portions, such as indicated at 165, each of which terminates in an in-turned flange 167. Fixedly secured and extending down from plate 88 of cooktop 92 at the corner portions is a shaft 170 which terminates in an enlarged head 173. Shaft 170 extends through an opening 177 formed in in-turned flange 167. In addition, a spring 182 is positioned between in-turned flange 167 and enlarged head 173. With this arrangement, spring 182 biases cooktop 92 relative to cabinet 30. In the embodiment shown, each spring 182 constitutes a tension spring which provides a biasing force for retaining panel 88 against top surface 17 of countertop 8. However, it should be understood that a compression spring could also act between cooktop 92 and cabinet 30 and used in combination with a locking arrangement, such as pin 155, to establish an overall locking and adjusting mechanism.

Based on the above, it should be readily apparent that the disclosure provides a cooktop module which is suspended upon a lower cabinet of a range and can be selectively, vertically adjusted or locked relative to the cabinet. The disclosed cooktop module is particularly applicable for use on both slide-in and drop-in ranges. In any case, although described with respect to the various embodiments of the disclosure, it should be readily apparent that various changes and/or modifications can be made to the invention without departing from the spirit thereof. For instance, the cabinet of the range can include side panels or take the form of an open framework cabinet, particularly when the sides of the range will be completely recessed behind adjacent cabinetry so that the sides are not visible once the range is fully installed. In addition, the control panel for the range can be provided as part of the cooktop module as set forth above, particularly given the ability to utilize flexible electrical wiring or gas lines, or mounted on the cabinet, such as along a front surface above an oven door and below the cooktop. In any event, the disclosure is only intended to be limited by the scope of the following claims.

I claim:

1. A cooking appliance comprising:

a cabinet;

an oven cavity mounted in the cabinet;

a cooktop positioned above the oven cavity; and a mechanism interconnecting the cooktop to the cabinet while permitting the cooktop to be vertically shifted relative to the oven cavity, wherein the mechanism includes at least one mechanical fastener which is configured to be loosened or removed to permit vertical downward shifting of the cooktop relative to the oven cavity, and tightened or replaced to secure the cooktop to the cabinet.

2. The cooking appliance according to claim 1, wherein the cooktop is constituted by a module, including a control panel and a glass panel provided with a plurality of heating elements, mounted upon the cabinet.

3. The cooking appliance according to claim 2, further comprising a locking mechanism for fixing the module in a select vertical position relative to the oven cavity.

4. The cooking appliance according to claim 1, wherein the at least one mechanical fastener is loosened to permit vertical shifting of the cooktop relative to the oven cavity and tightened to secure the cooktop to the cabinet.

5. The cooking appliance according to claim 4, wherein the cooktop takes the form of a module including side walls and the mechanism includes at least one slot formed in each side wall, with the at least one mechanical fastener extending through the at least one slot and being threaded into the cabinet.

6. The cooking appliance according to claim 1, wherein the at least one mechanical fastener is removed to permit vertical shifting of the cooktop relative to the oven cavity and replaced to secure the cooktop to the cabinet.

7. The cooking appliance according to claim 1, wherein the mechanism includes at least one spring acting between the cooktop and the cabinet.

8. The cooking appliance according to claim 7, wherein the at least one spring applies a downward biasing force upon the cooktop.

9. The cooking appliance according to claim 8, wherein the at least one spring is a tension spring.

10. The cooking appliance according to claim 1, wherein the cooking appliance constitutes a range mounted within a cut-out portion of a countertop and the cooktop includes a panel which extends over edge portions of the countertop.

11. A cooking appliance comprising:

a cabinet;

an oven cavity mounted in the cabinet;

a cooktop positioned above the oven cavity; and a mechanism interconnecting the cooktop to the cabinet while permitting the cooktop to be vertically shifted relative to the oven cavity, wherein the mechanism includes at least one mechanical fastener which is configured to be loosened or removed to permit vertical shifting of the cooktop relative to the oven cavity, and tightened or replaced to secure the cooktop to the cabinet, wherein the at least one mechanical fastener comprises a pin configured to be received in an aperture formed in an outer side panel of the cooking appliance.

12. The cooking appliance according to claim 11, wherein a plurality of apertures are provided for selective receipt of the at least one pin to lock the cooktop in a desired vertical position relative to the oven cavity.

13. A method of mounting a range, including a lower oven cavity and an upper cooktop, in an opening provided along a countertop comprising:

vertically adjusting the upper cooktop relative to the lower oven cavity; and positioning the range, including both the lower oven cavity and the upper cooktop simultaneously, within the opening, wherein vertically adjusting the upper cooktop includes loosening or removing at least one mechanical fastener to permit vertical downward shifting of the cooktop relative to the oven cavity.

14. The method of claim 13, wherein the range is positioned within the opening, with the lower oven cavity being exposed below the countertop and at least a panel of the upper cooktop resting upon edge portions of the countertop.

15. The method of claim 14, further comprising: simultaneously vertically adjusting oven controls with the upper cooktop relative to the lower oven cavity.

16. The method of claim 14, further comprising: locking the upper cooktop in a select vertical position relative to the oven cavity prior to positioning the range within the opening.

17. The method of claim 16, wherein the upper cooktop is locked in the select vertical position prior to positioning the range within the opening.

18. The method of claim 16, wherein locking the upper cooktop includes tightening or replacing the at least one mechanical fastener.

19. The method of claim 14, further comprising: lowering the upper cooktop onto the countertop after positioning the range within the opening.

20. The method of claim 19, further comprising: biasing the upper cooktop into engagement with the countertop.

* * * * *